US005334269A

United States Patent [19]

Khare et al.

[11] Patent Number: 5,334,269

[45] Date of Patent: * Aug. 2, 1994

[54] INTERRUPTED NORMALIZATION HEAT TREATMENT PROCESS

[75] Inventors: Ashok K. Khare; Michael Scott, both of Warren, Pa.

[73] Assignee: National Forge Company, Irvine, Pa.

[ * ] Notice: The portion of the term of this patent subsequent to Dec. 29, 2009 has been disclaimed.

[21] Appl. No.: 963,877

[22] Filed: Oct. 20, 1992

Related U.S. Application Data

[63] Continuation of Ser. No. 845,856, Mar. 3, 1992, Pat. No. 5,334,269, which is a continuation of Ser. No. 496,602, Mar. 21, 1990, abandoned.

[51] Int. Cl.[5] ..... C21D 1/20

[52] U.S. Cl. ..... 148/638; 148/641; 148/663

[58] Field of Search ..... 148/638, 641, 663

[56] References Cited

U.S. PATENT DOCUMENTS

| | | | |
|---|---|---|---|
| 4,016,009 | 4/1977 | Economopoulos et al. | 148/598 |
| 4,204,892 | 5/1980 | Economopoulos | 148/663 |
| 4,295,902 | 10/1981 | Economopoulos | 148/663 |

FOREIGN PATENT DOCUMENTS

| | | | |
|---|---|---|---|
| 229877 | 11/1985 | German Democratic Rep. . | |
| 1052842 | 12/1966 | United Kingdom | 148/663 |

*Primary Examiner*—Richard O. Dean
*Assistant Examiner*—Margery S. Phipps
*Attorney, Agent, or Firm*—Hale and Dorr

[57] ABSTRACT

An interrupted normalize heat treatment process for ferritic alloy steel that includes the steps of rapidly cooling at least the outer surfaces of the steel from a temperature above the Ac temperature to a temperature below the Ar, temperature and during subsequent air cooling to room temperature reheating the outside surfaces of the ferritic alloy steel back above the Ar, temperature by bleed back heat from the steel, and forming an as interrupting normalized workpiece having substantially bainitic structures.

10 Claims, No Drawings

INTERRUPTED NORMALIZATION HEAT TREATMENT PROCESS

This is a continuation of application Ser. No. 07/845,856, filed Mar. 3, 1992, now U.S. Pat. No. 5,334,269 which is a continuation of Ser. No. 07/496,602, filed Mar. 21, 1990, abandoned, entitled INTERRUPTED NORMALIZE HEAT TREATMENT PROCESS.

TECHNICAL FIELD

The present invention relates heat treatment processes for ferritic alloy steels. More specifically, the present invention relates to heat treatment processes for ferritic alloy steel that gives such steel improved properties and microstructure.

BACKGROUND OF THE INVENTION

It is known to heat treat ferritic alloy steel to obtain properties. It is known also that the rate of cooling during heat treatment is the most critical aspect and it is through the rate of cooling that different properties will obtain. Heat treatment may comprise a single process or combination of processes.

In heat treating ferritic alloy steel, there are two transformation temperature ranges: one for heating and one for cooling. The heating transformation temperature range is denoted by the range $Ac_1$–$Ac_3$, where $Ac_1$ is the temperature at which austenite begins to form and $Ac_3$ is the temperature at which the transformation of ferrite and cementite to austenite is complete. The cooling transformation temperature range is denoted by the range $Ar_1$–$Ar_3$, where $Ar_1$ is the temperature at which the transformation of austenite to ferrite plus cementite is complete and $Ar_3$ is the temperature at which austenite begins to transform to ferrite plus cementite.

Two well known heat treatment methods are normalizing and tempering:

Standard normalizing is a heating and cooling process for refining the grain size of ferritic alloy steel. That is, the process makes the steel's microstructure more uniform. Standard normalizing is performed by heating the steel to a temperature above $Ac_3$ and then air cooling such steel to room temperature. This process provides moderate hardening. The microstructure of as standard normalized AISI 4130 grade alloy steel is pearlite plus ferrite.

Tempering is a reheating and cooling process for softening ferritic alloy steel (viz., decreasing hardness, tensile strength, and yield strength), toughening the steel, and increasing the steel's ductility (viz., % elongation and % reduction in area). Tempering is performed by heating the standard normalized ferritic alloy steel to a temperature below $Ac_1$ and cooling the steel to room temperature at any desired rate. Tempering causes no significant effect on the microstructure of AISI 4130 grade alloy steel.

The present invention provides a heat treatment process that imparts properties to ferritic alloy steel that are an improvement over those imparted by standard normalizing or tempering alone or in combination.

SUMMARY OF THE INVENTION

The present invention is an interrupted normalize heat treatment process that imparts improved properties to ferritic alloy steel.

According to the present invention, a workpiece made from ferritic alloy steel is heated to a temperature above $Ac_3$. The steel is soaked at this temperature for a predetermined period of time. At the end of this period, the workpiece is placed in a cooling medium for a predetermined short period of time. This short period of time, however, is long enough for the surface of the workpiece to be cooled rapidly to a temperature below $Ar_1$.

Once the outside surfaces of the workpiece have been cooled below $Ar_1$, the workpiece is removed from the cooling medium and air cooled. In air cooling the workpiece, the retained heat of the workpiece bleeds back to reheat the cooled surface of the workpiece to a temperature back above at least $Ar_1$. After the workpiece has been air cooled to room temperature, it may be tempered.

The as interrupted normalized, or the as interrupted normalized and tempered, workpiece has improved properties over what will obtain by standard normalizing, or this method combined with tempering.

An object of the present invention is to provide an interrupted normalize heat treatment process for ferritic alloy steel that imparts improved properties to the steel over those imparted by conventional normalizing and/or tempering heat treatment methods.

A further object of the present invention is provide a heat treatment process for ferritic alloy steel that will impart to the steel in the as treated condition a microstructure containing bainitic structures.

These and other objects of the present invention will be explained in detail in the remainder of the specification.

DETAILED DESCRIPTION OF THE INVENTION

The present invention is an interrupted normalize heat treatment process that imparts improved properties to ferritic alloy steel.

In the process of the present invention, a large section, large mass workpiece made from ferritic alloy steel is placed in a furnace and heated to a temperature above $Ac_3$. Since the transformation from ferrite and cementite to austenite is a time dependent process, the workpiece is soaked at the temperature above $Ac_3$ for a predetermined period of time to ensure the microstructure transformation is complete.

Once the large section, large mass workpiece has been soaked, it is removed from the furnace and placed in a cooling medium. This rapidly cools the outside surfaces of the workpiece to a temperature below $Ar_1$. In this cooling process, not only are the outer surfaces cooled below $Ar_1$, but also an adjacent surface layer is cooled below $Ar_1$. In rapidly cooling the outside surfaces and the adjacent surface layer, bainitic colonies are formed in the austenite.

Preferably, the cooling medium is water. It is understood that the cooling medium may be an another fluid as long as the fluid will rapidly cool the outside surfaces and adjacent surface layer in a short period of time.

After it is determined that the temperature at the outside surfaces of the workpiece is below $Ar_1$, the workpiece is removed from the cooling medium and allowed to air cooled. In air cooling the workpiece, the retained heat of the large section, large mass workpiece bleeds back to reheat the cooled outer surfaces and adjacent surface layer back above at least the $Ar_1$, preferably above $Ar_3$.

Once the cooled outside surfaces and adjacent surface layer are reheated back above $Ar_1$, the microstructure of the outer surfaces and surface layer do not return completely to austenite. Hence, bainitic colonies remain even after the outer surfaces and adjacent surface layer are reheated. The remaining austinite which did not transform into bainite forms pearlite and ferrite during subsequent cooling to room temperature.

The microstructure of the as interrupted normalized workpiece includes predominantly bainitic structures. At the mid-radius location in the later shown examples, there was about 65% upper bainite, about 30% pearlite, and about 5% ferrite. At the surface location in the later shown examples, there is about 65% lower bainite and 35% upper bainite. The microstructure of an as standard normalized workpiece would consist of about 90% pearlite, about 10% ferrite, and trace amounts of bainite.

It is the existence of the bainite microstructure gives the ferritic alloy steel processed by the interrupted normalize heat treatment process of the present invention generally improved mechanical properties. Further, there is a substantial improvement in the tensile/yield ratio, which means that the steel has a higher yield strength as a percentage of tensile strength.

After the workpiece is interrupted normalized, it may be tempered. Even in the as tempered condition, the workpiece has improved properties over what will obtain by standard normalizing or standard normalizing and tempering in a conventional manner.

EXAMPLES

Five workpieces of AISI 4130 grade alloy steel were made. Each workpiece had a 8 1/16 inch section size. Three of the workpieces weighed 4775 lbs. and two weighed 3900 lbs.

In processing the workpieces in accordance with the present invention, each workpiece was heated in a furnace to 1700° F. and held at that temperature for 8 hours. The 1700° F. temperature is above $Ac_3$. After the 8 hours, the workpieces were removed from the furnace and immediately placed in a cooling medium, water, to rapidly cool the outside surfaces and adjacent surface layer. The workpieces were removed from the cooling medium after about 60 seconds. After 60 seconds, the temperature at the outside surfaces and adjacent surface layer of each workpiece was below $Ar_1$.

After the workpieces were removed from the cooling medium, they were allowed to air cool to room temperature. In air cooling, the retained heat in each workpiece bled back to reheat the surface layer and outer surfaces to a temperature back above at least $Ar_1$.

Following air cooling to room temperature, the workpieces were tempered by heating them to 1260° F. and then holding them at that temperature for 12 hours. After 12 hours, the workpieces were air cooled to room temperature.

The ladle chemistry of the heats from which the test workpieces were made are shown in Table 1 compared with the standard AISI 4130 chemistry:

TABLE 1

| | | Heats | | |
|---|---|---|---|---|
| Elements | AISI 4130 % By Weight | 6-8238 % By Weight | 6-8264 % By Weight | 6-8437 % By Weight |
| Carbon | 0.28–0.33 | 0.31 | 0.30 | 0.31 |
| Manganese | 0.40–0.60 | 0.48 | 0.53 | 0.51 |

TABLE 1-continued

| | | Heats | | |
|---|---|---|---|---|
| Elements | AISI 4130 % By Weight | 6-8238 % By Weight | 6-8264 % By Weight | 6-8437 % By Weight |
| Phosphorus | 0.035 max. | 0.006 | 0.010 | 0.007 |
| Sulphur | 0.040 max. | 0.012 | 0.005 | 0.007 |
| Silicon | 0.15–0.35 | 0.31 | 0.25 | 0.30 |
| Nickel | 0.25 max. | 0.17 | 0.11 | 0.14 |
| Chromium | 0.80–1.10 | 0.90 | 0.90 | 0.89 |
| Molybdenum | 0.15–0.25 | 0.20 | 0.20 | 0.22 |

Properties of the five workpieces were taken at the longitudinal, mid-radius location in the as standard normalized, the as interrupted normalized, and the as interrupted normalized and tempered conditions. Properties were also taken at the longitudinal, surface location in the as interrupted normalized and tempered condition for four of the five workpieces. These properties are shown in Table 2:

TABLE 2

| | | Mechanical Properties | | | |
|---|---|---|---|---|---|
| Heat Treatment | Location | Tensile Strength In ksi | 0.2% Yield Strength In ksi | % Elong. | % Red. Area |
| ID No. 4752 (Heat No. 6-8437) 4775 lb. Heat Treatment Weight | | | | | |
| Std. Norm. | Long., Mid-Radius | 90.5 | 47.0 | 24.0 | 51.0 |
| Int. Norm. | Long., Mid-Radius | 113.0 | 81.0 | 17.0 | 54.0 |
| Int. Norm. & Temp. | Long., Mid-Radius | 87.5 | 62.0 | 24.0 | 66.0 |
| Int. Norm. & Temp. | Long., Surface | 96.5 | 72.5 | 24.0 | 70.0 |
| ID No. 4761 (Heat No. 6-8437) 4775 lb. Heat Treatment Weight | | | | | |
| Std. Norm. | Long., Mid-Radius | 92.5 | 47.5 | 23.0 | 50.0 |
| Int. Norm. | Long., Mid-Radius | 114.0 | 84.0 | 19.0 | 55.0 |
| Int. Norm. & Temp. | Long., Mid-Radius | 87.5 | 62.5 | 24.0 | 65.0 |
| Int. Norm. & Temp. | Long., Surface | 95.0 | 70.5 | 23.0 | 69.0 |
| ID No. 4415 (Heat No. 6-8238) 4775 lb. Heat Treatment Weight | | | | | |
| Std. Norm. | Long., Mid-Radius | 91.5 | 47.0 | 23.0 | 43.0 |
| Int. Norm. | Long., Mid-Radius | 110.0 | 72.5 | 12.0 | 47.0 |
| Int. Norm. & Temp. | Long., Mid-Radius | 95.5 | 62.0 | 22.0 | 63.0 |
| Int. Norm. & Temp. | Long., Surface | 88.5 | 63.0 | 23.0 | 65.0 |
| ID No. 4552 (Heat No. 6-8264) 3900 lb. Heat Treatment Weight | | | | | |
| Std. Norm. | Long., Mid-Radius | 91.5 | 48.0 | 23.0 | 44.0 |
| Int. Norm. | Long., Mid-Radius | 106.0 | 68.0 | 15.0 | 52.0 |
| Int. Norm. & Temp. | Long., Mid-Radius | 89.5 | 57.5 | 21.0 | 65.0 |
| ID No. 4557 (Heat No. 6-8264) 3900 lb. Heat Treatment Weight | | | | | |
| Std. | Long., | 89.5 | 47.5 | 24.0 | 48.0 |

TABLE 2-continued

| Heat Treatment | Location | Mechanical Properties Tensile Strength In ksi | 0.2% Yield Strength In ksi | % Elong. | % Red. Area |
|---|---|---|---|---|---|
| Norm. | Mid-Radius Long., | 114.0 | 77.5 | 11.0 | 47.0 |
| Int. Norm. | Mid-Radius Long., | 89.5 | 57.0 | 25.0 | 63.0 |
| Int. Norm. & Temp. | Mid-Radius Long., Surface | 90.0 | 57.5 | 26.0 | 66.0 |

In Table 2, Std. Norm. means standard normalize, Int. Norm. means interrupted normalize, Int. Norm. & Temp. means interrupted normalize and temper, Long. means longitudinal, % Elong. means % elongation, and % Red. Area means % reduction in area. The standard normalizing process includes heating the test workpieces to 1650° F., which is above $Ac_3$ and then cooling the workpieces to room temperature.

The terms and expressions which are used herein are used as terms of expression and not of limitation. And, there is no intention, in the use of such terms and expressions, of excluding the equivalents of the features shown and described, or portions thereof, it being recognized that various modifications are possible in the scope of the invention.

We claim:

1. A process for normalizing a ferritic alloy steel that includes the steps of rapidly cooling at least outer surfaces of the steel from a temperature above the $Ac_3$ temperature to a temperature below the $Ar_1$ temperature and forming bainitic structures in the outer surfaces, and during subsequent air cooling to room temperature reheating the outer surfaces of the steel to a temperature at least above the $Ar_1$ temperature with bleed back heat from the steel and retaining as many bainitic structures as possible at the outer surfaces, thereby forming an alloy steel with outer surfaces and interior portions adjacent thereto having predominantly bainitic structures.

2. The method as recited in claim 1, wherein the reheating step includes reheating the outer surfaces of the steel to a temperature above the $Ar_3$ temperature with bleed back heat from the steel.

3. A process for normalizing large section, large mass ferritic alloy steel workpieces that includes the steps of rapidly cooling at least outer surfaces of a workpiece from a temperature above the $Ac_3$ temperature to a temperature below the $Ar_1$ temperature and forming bainitic structures in the outer surfaces and during subsequent air cooling to room temperature reheating the outer surfaces of the workpiece to a temperature at least above the $Ar_1$ temperature with bleed back heat from the workpiece and retaining as many bainitic structures as possible at the outer surfaces, thereby forming an alloy steel with outer surfaces and predominately bainitic structures.

4. The method as recited in claim 3, wherein the reheating step includes reheating the outer surface of the workpiece to a temperature above the $Ar_3$ temperature with bleed back heat from the workpiece.

5. A process for normalizing a ferritic alloy steel that includes the steps of rapidly cooling at least outer surfaces of the steel from a temperature above the $Ac_3$ temperature to a temperature below the $Ar_1$ temperature and forming bainitic structures in the outer surfaces and during subsequent air cooling to room temperature reheating the outer surfaces of the steel to a temperature at least above the $Ar_1$ temperature with bleed back heat from the steel, thereby forming an alloy steel having predominately bainitic structures.

6. The process as recited in claim 5, wherein the forming step includes forming an as normalized steel having substantially bainitic structures, and lesser amounts of pearlite and ferrite.

7. The method as recited in claim 5, wherein the reheating step includes reheating the outer surfaces of the steel to a temperature above the $Ar_3$ temperature with bleed back heat from the steel.

8. A process for normalizing large section large mass ferritic alloy steel workpieces that includes the steps of rapidly cooling at least outer surfaces of a workpiece from a temperature above the $Ac_3$ temperature to a temperature below the $Ar_1$ temperature and forming bainitic structures in the outer surfaces and during subsequent air cooling to room temperature reheating the outer surfaces of the workpiece to temperature at least above the $Ar_1$ temperature with bleed back heat from the workpiece, and forming an as normalized workpiece having predominately bainitic structures.

9. The process as recited in claim 8, wherein the forming step includes forming an as normalized workpiece having substantially bainitic structures, and lesser amounts of pearlite and ferrite.

10. The method as recited in claim 8, wherein the reheating step includes reheating the outer surface of the workpiece to a temperature above the $Ar_3$ temperature with bleed back heat from the workpiece.

* * * * *